US009789362B1

(12) United States Patent
Su et al.

(10) Patent No.: US 9,789,362 B1
(45) Date of Patent: Oct. 17, 2017

(54) EXERCISE SYSTEM AND ADJUSTMENT METHOD THEREOF

(71) Applicant: Strength Master Fitness Tech. Co., Ltd., Changhua County (TW)

(72) Inventors: Ming-Chu Su, Changhua County (TW); Shu-Yao Wu, Changhua County (TW)

(73) Assignee: Strencth Master Fitness Tech Co., Ltd., Puxin Township (TW)

( * ) Notice: Subject to any disclaimer, the term of this patent is extended or adjusted under 35 U.S.C. 154(b) by 0 days.

(21) Appl. No.: 15/136,640

(22) Filed: Apr. 22, 2016

(51) Int. Cl.

| | |
|---|---|
| ***A63B 24/00*** | (2006.01) |
| ***A63B 23/12*** | (2006.01) |
| ***A63B 71/00*** | (2006.01) |
| ***A63B 21/06*** | (2006.01) |
| ***A63B 22/06*** | (2006.01) |
| ***A63B 23/04*** | (2006.01) |
| ***A63B 71/06*** | (2006.01) |

(52) U.S. Cl.
CPC ..... *A63B 24/0075* (2013.01); *A63B 21/06* (2013.01); *A63B 22/0605* (2013.01); *A63B 23/0476* (2013.01); *A63B 23/12* (2013.01); *A63B 24/0062* (2013.01); *A63B 24/0087* (2013.01); *A63B 71/0054* (2013.01); *A63B 71/0622* (2013.01); *A63B 2024/0065* (2013.01); *A63B 2071/0072* (2013.01)

(58) Field of Classification Search
CPC . A63B 24/0075; A63B 24/00; A63B 24/0062; A63B 24/0087; A63B 23/12; A63B 71/0054; A63B 21/0605; A63B 22/02; A63B 22/001; A63B 22/00
See application file for complete search history.

(56) References Cited

U.S. PATENT DOCUMENTS

| | | | | |
|---|---|---|---|---|
| 5,476,430 | A * | 12/1995 | Lee | A63B 22/02 482/3 |
| 2004/0072651 | A1* | 4/2004 | Liu | A63B 22/001 482/8 |
| 2007/0265138 | A1* | 11/2007 | Ashby | A63B 22/02 482/8 |
| 2010/0222178 | A1* | 9/2010 | Shea | A63B 22/00 482/4 |

* cited by examiner

*Primary Examiner* — Glenn Richman
(74) *Attorney, Agent, or Firm* — Wang Law Firm, Inc.

(57) ABSTRACT

An exercise system and an adjustment method thereof. The exercise system includes an exercise machine and a data transmission device. The exercise machine includes a control unit, a storage unit, a stepless force device, a sensor, a user operation part and an operation interface. During exercise, the control unit executes the exercise program to dynamically change resistance according to a sensed location, speed or acceleration of the user operation part and an adjustable parameter. Through the data transmission device, the user can download the personal training parameter from a remote device into the exercise machine, or upload the training result and the personal training parameter to the remote device.

10 Claims, 5 Drawing Sheets

EXERCISE SYSTEM AND ADJUSTMENT METHOD THEREOF

BACKGROUND OF THE INVENTION

1. Field of the Invention

The present disclosure relates to an exercise system, more particularly to an exercise system capable of conveniently personalize training parameters of the exercise machine, and an adjustment method thereof.

2. Description of the Related Art

For better life quality, general public pay more attention in exercise, and some research institutes also appeal importance of periodic aerobic exercise, strength training and endurance training which are helpful for cardiopulmonary function, and muscular strength and endurance.

Most of conventional weight training machines use weight-training masses to provide resistance for training, and the user can select an appropriate number of weight-training masses upon physical strength and then start training by a manner of raising the selected weight-training masses. However, the conventional weight training machine is usually just provided with ten to twenty weight-training masses which each has 5 lbs of weight, so the user can only perform weight training in limited-steps. In addition, when the user operates the conventional weight training machine to raise the weight-training masses faster, the user is subjected to a higher inertia force while the weight-training masses fall in reverse movement, which easily results in sport injury.

Moreover, during the exercise on the conventional weight training machine, the gravity applied during the pull movement and the reverse movement of the exercise is the same, but muscle usually has different strength performances in eccentric contraction (in the reverse movement) and contraction (in the pull movement). The conventional weight training machine is disadvantageous to optimize the user's training performance.

In order to solve above-described problem of the conventional weight training machine, other commercially available training machine allows the user to select the resistance for training by using at least one pin.

However, if the user do exercise on different weight training machine for every training, the user must remember all training parameters including resistance values, limb movement ranges, training duration or training cycles, and it is very inconvenient for the user who performs weight training periodically, and may decrease the user's intention for exercise. In addition, the user has different physical condition every day, and is injured easily when performing the weight training accord to the same training parameter every time.

SUMMARY OF THE INVENTION

An objective of the present disclosure is to provide an exercise system in which a personal training parameter is stored in a remote device (such as a cloud server or the user's mobile phone), so that the complexity of setting the personal training parameters in the exercise machine can be reduced and the user's experience in exercise can be improved.

In order to achieve the objective, the present disclosure provides an exercise system including an exercise machine and a data transmission device. The exercise machine includes a user operation part, a stepless force device, a sensor, a storage unit, an operation interface and a control unit. The user operation part is configured to be operated by a user for exercise. The stepless force device is configured to apply resistance on the user operation part. The sensor is configured to sense a location, a speed or an acceleration of the user operation part. The storage unit is configured to store a software application program, an exercise program, a personal training parameter and a training result. The exercise program includes a preset resistance setting function and an adjustable parameter which has a corresponding relationship with the location, the speed or the acceleration of the user operation part. The operation interface is configured to provide the user to set the personal training parameter. The control unit is configured to execute the exercise program to control the stepless force device to output resistance according to the personal training parameter, and dynamically change the resistance during exercise of the user according to the location, the speed or the acceleration and the adjustable parameter, and record the training result, and execute the software application program to display exercise information on the operation interface. The data transmission device is configured to communicate with a remote device. Through the data transmission device, the control unit selectively downloads the personal training parameter from the remote device or uploads the training result and the personal training parameter to the remote device.

In order to achieve the objective, the present disclosure provides an adjustment method for an exercise machine having a data transmission function. The method includes following steps: storing a personal training parameter in a remote device; connecting the exercise machine and the remote device and downloading the personal training parameter into the exercise machine; controlling the exercise machine to execute an exercise program to apply stepless resistance on a user operation part of the exercise machine according to the personal training parameter, and wherein the user operates the user operation part for exercise, and the exercise program includes a preset resistance setting function and an adjustable parameter which has a corresponding relation with a location, a speed or an acceleration of the user operation part; sensing the location, the speed or the acceleration of the user operation part which is being operated; during exercise of the user, dynamically adjusting the stepless resistance according to the location, the speed or the acceleration and the adjustable parameter.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
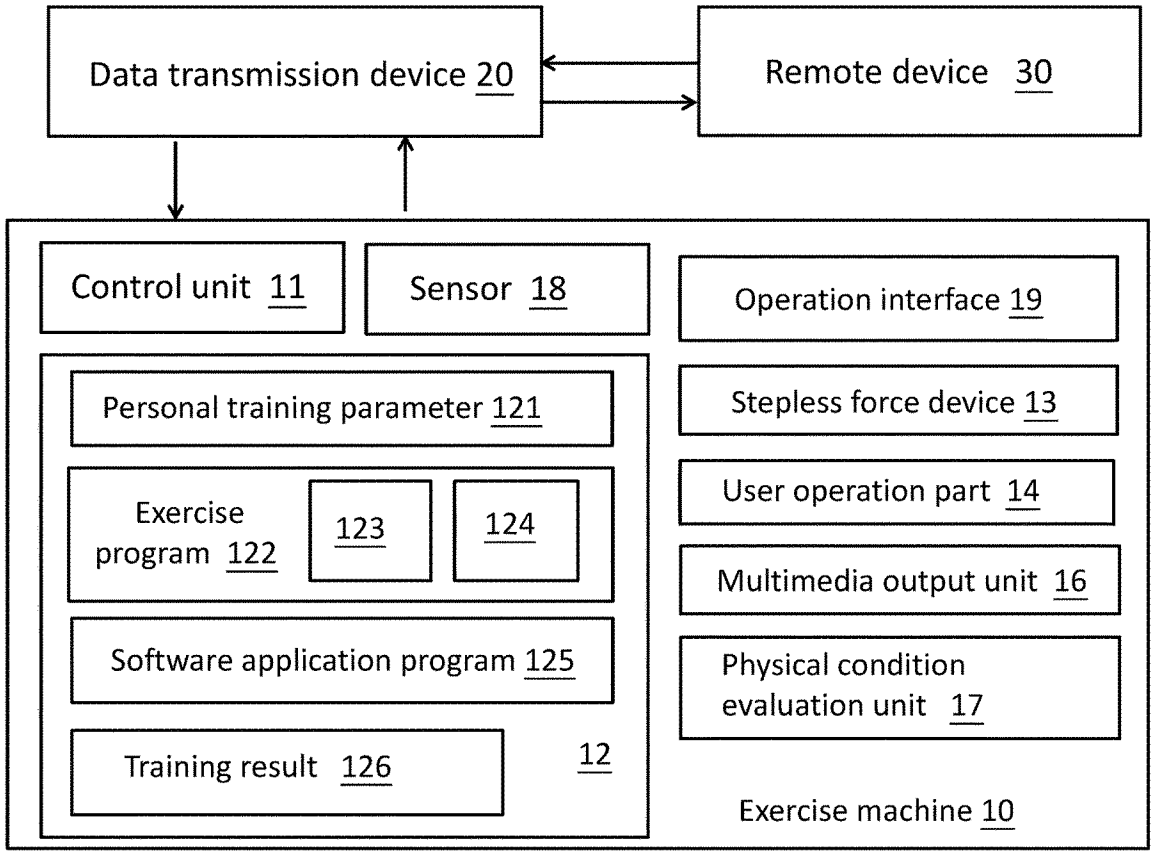
FIG. 1 is a block diagram of an exercise system of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Please refer to FIG. 1 which shows a block diagram of an exercise system of the present disclosure. The exercise system includes an exercise machine 10 and a data transmission device 20. The exercise machine 10 includes a control unit 11, a storage unit 12, a stepless force device 13, a user operation part 14 and an operation interface 19. The storage unit 12 is configured to store a personal training parameter 121, an exercise program 122, a software application program 125 and a training result 126. The operation interface 19 is configured to provide the user to set the personal training parameter 121, and the control unit 11 can execute the software application program 125 to display exercise information on the operation interface 19.

The data transmission device 20 is configured to communicate with a remote device 30. Through the data transmission device 20, the control unit 11 can selectively download the personal training parameter 121 from the remote device 30 or upload the training result 126 and the personal training parameter 121 to the remote device 30.

According to the personal training parameter 121, the control unit 11 executes the exercise program 122 to control the stepless force device 13 to apply stepless resistance on the user operation part 14 for exercise of the user. Preferably, the data transmission device 20 can be built in the exercise machine 10, and the data transmission device 20 and the control unit 11 can be implemented by a processor or a microcontroller capable of executing program. Alternatively, the control unit 11 can be a processor or a microcontroller built in the exercise machine 10, and the data transmission device 20 is a computer disposed outside the exercise machine 10 and electrically connected with the control unit 11 of the exercise machine 10, and one computer can be operative to manage many exercise machines 10.

The sensor 18 is configured to sense a location, a speed or an acceleration of the user operation part 14. The exercise program 122 has a preset resistance setting function 123 and an adjustable parameter 124 which has a corresponding relation with the location, the speed or the acceleration of the user operation part 14. Preferably, the corresponding relation can be a linear relation, a nonlinear relation or a function, and the user can set the corresponding relation through the operation interface 19. When the control unit 11 starts to execute the exercise program 122, the user initially operates the user operation part 14 under the preset resistance, but the stepless force device 13 will dynamically adjust the stepless resistance later according to the location, the speed or the acceleration sensed by the sensor 18, and the adjustable parameter 124.

For example, the exercise machine 10 can be a strength training machine, and the stepless force device 13 is an electric actuator, such as a motor. The user operation part 14 includes at least one rope and at least one handle connected with an end of the rope, and the other end of the rope is connected with the stepless force device 13, such as the motor. The motor outputs torque on the rope to generate the stepless resistance, so that the user holds the handle to move back and forth repeatedly for exercise.

In the embodiment, before exercise, the user can select an exercise mode or download the personal training parameter 121 from the remote device 30, so as to determine a resistance distribution. Next, during the exercise of the user, the sensor 18 senses the location, the speed or the acceleration of the rope, and the control unit 11 multiplies the sensed location, the speed or the acceleration by the adjustable parameter 124, to calculate a compensation force value, and then adjust torque output of the motor according to the compensation force value.

Figure 3:
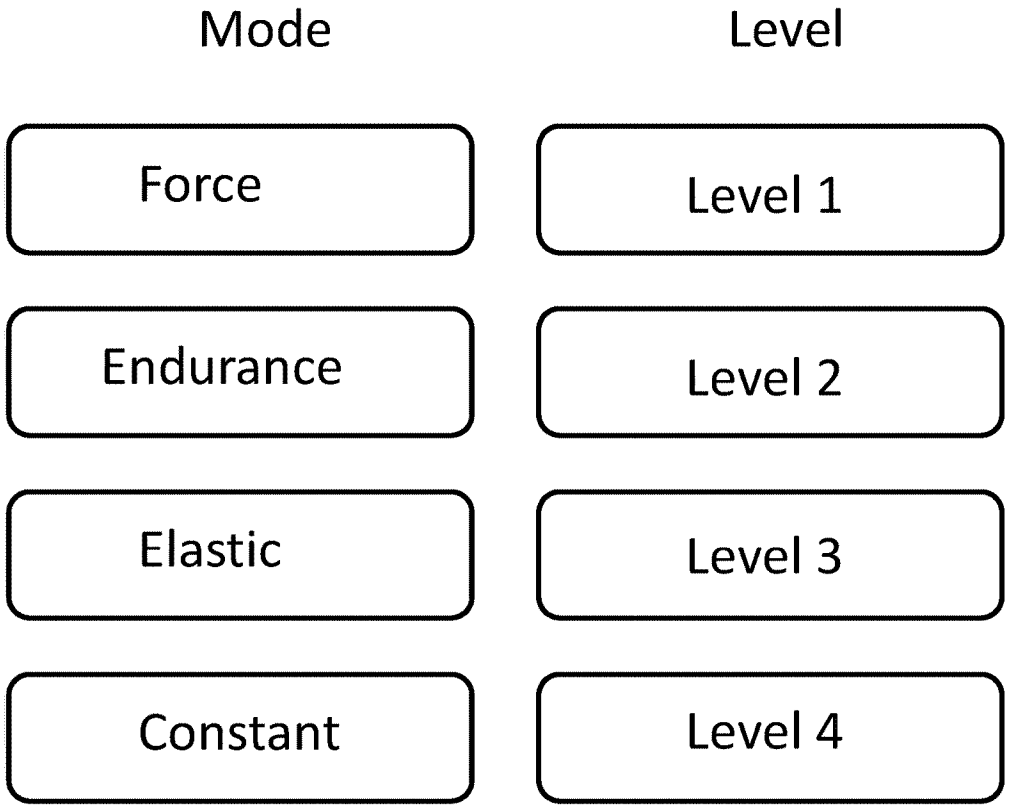
FIGS. 3 and 4 are schematic views of operation interfaces of the exercise system of the present disclosure.
Figure 4:
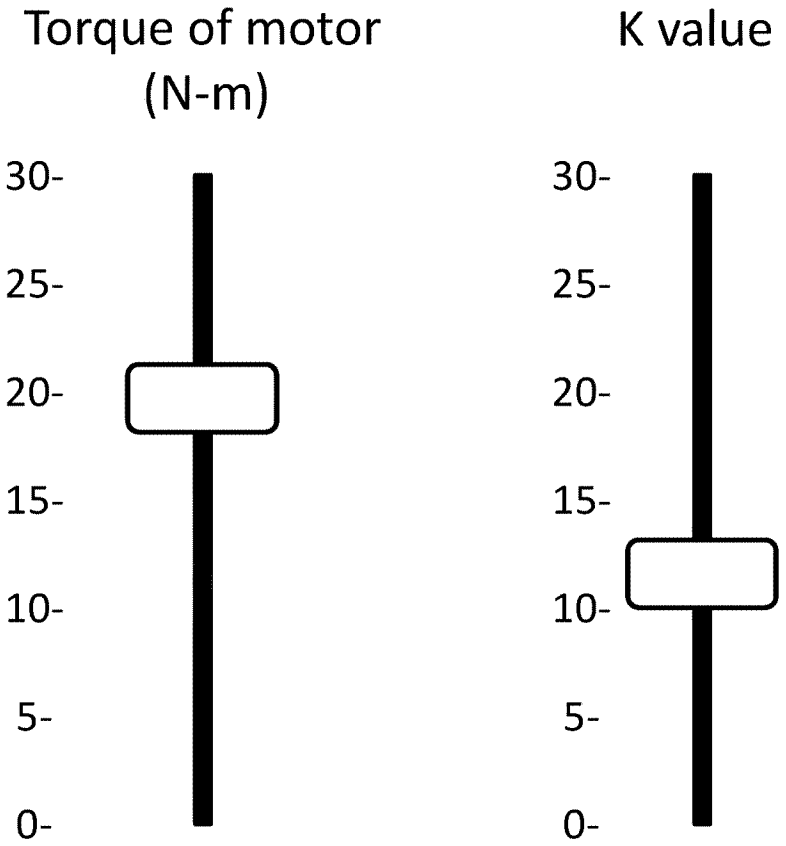

For example, when the corresponding relation is the linear relation and the user sets the adjustable parameter 124, such as the K value shown in FIG. 3, the control unit 11 multiplies the sensed acceleration by the K value set by the user, so as to obtain the compensation force value, and then adjusts the torque output of the motor according to the compensation force value. Therefore, the exercise system of the present disclosure can achieve the optimization of training and prevent the user from sport injury effectively.

During the process of operating a conventional weight training machine, when the user pulls the rope faster, the weight-training masses are risen faster and the user will be subjected to a larger inertia force while the weight-training masses falls in a reverse movement of the exercise, which may result in sport injury easily. The stepless force device 13 of the exercise machine 10 of the present disclosure can dynamically adjust the resistance during the training action of the user, so as to prevent the user from being injured subjected to the inertia force during the exercise.

The muscle of a limb of human body has different strength performances in eccentric contraction (in the reverse movement of the exercise) and contraction (in the pull movement of the exercise) respectively, so the user possibly strains muscle accidentally while operating the conventional weight training machine only providing the same training force in both pull movement and reverse movement. In an embodiment, the stepless force device 13 of the exercise machine 10 of the present disclosure can dynamically adjust the force applied on the user operation part 14 according to the user's training action, and respectively output different resistances in pull movement and reverse movement of the exercise, so as to effectively prevent the user from straining muscle during exercise.

One action of the exercise usually involves several muscles, and the requirements of strength of the muscles are different. The conventional weight training machine only provides the same strength during entire process of the action, so it fails to optimize the muscle training and easily causes sport injury for the user. In an embodiment, the stepless force device 13 of the exercise machine 10 of the present disclosure can dynamically adjust the resistance during the process of the action, so that the muscle training can be optimized and the user can be prevent from sport injury effectively.

Every user usually has a dominant hand, so strength of left and right hands are different. In an embodiment, the stepless force device 13 of the exercise machine 10 can apply different resistances on left and right hand parts of user operation part 14, so as to balance the strength training for the user's two hands.

In other embodiment, the exercise machine 10 can be an aerobic exercise machine, such as a flywheel machine, and the user operation part 14 of the flywheel machine includes steps and a wheel. The user can cycle the steps to rotate the wheel, and the stepless force device 13 dynamically applies the resistance on the wheel for exercise.

It should be noted that objective of the present disclosure is to simplify the personalization operation of the exercise machine and dynamically adjust the resistance during exercise, but not directed to improve a mechanical structure of the exercise machine, so detailed description about the mechanical structure of the exercise machine is omitted. The above-mentioned descriptions represent merely the exemplary embodiment of the exercise machine of the present disclosure, without any intention to limit the scope of the present disclosure thereto.

According to above-described content, it should be understood that the resistance output of the stepless force device 13 is time-varying and dynamic, and the stepless force device 13 can also output different resistances for operations of the user's left and right hands. However, if the user desires a best exercise effect and experience, the user needs to respectively set many training parameters for the dynamic resistance output of the stepless force devices 13 of different exercise machines, and it is inconvenient for the user.

Therefore, the exercise system of the present disclosure has an advantage that the exercise machine 10 can download the personal training parameter from the remote device 30, so as to effectively improve convenience in operating the exercise machine 10. Preferably, the remote device 30 can be a cloud server or the user's mobile phone, and the data transmission device 20 can be a network device (such as a Wi-Fi device or wired network device) or a short-range wireless communication device (such as a Bluetooth device).

In an embodiment, the personal training parameters 121 can include training category, limb movement range, resistance value, power value, training time, training cycles, K value and so on. The personal training parameter 121 can also include different training parameters for left hand and right hand.

In addition, during the exercise, the control unit 11 can record the exercise information of the user operation part 14, such as moving distance, speed, acceleration of the user operation part 14, for calculating the limb movement range, the limb movement speed, force, and calorie consumption of the user. After the user completes the exercise, the control unit 11 can upload the training result 126 integrating the exercise information, to the remote device 30 for storage and further analysis, so that the user can understand the exercise condition according to the analysis result.

In an embodiment, the control unit 11 can compare the exercise information with the personal training parameter 121 to determine adjustment of the resistance, and also selectively adjust the personal training parameter 121. For example, if according to exercise information the control unit 11 determines that the user's operation speed becomes slower, it indicates that the user's current physical strength may not bear current training, so the control unit 11 may control the stepless force device 13 to reduce the resistance. Otherwise, if according to exercise information the control unit 11 determines that the user's operation speed becomes faster, it indicates that the user has better physical strength for stronger training, so the control unit 11 may control the stepless force device 13 to increase the resistance. When above-described situation occurs, the control unit 11 can automatically adjust the personal training parameter 121, or generate a prompt message for noticing the user to determine adjustment of the personal training parameter 121.

In an embodiment, the exercise system of the present disclosure further includes a physical condition evaluation unit 17. Because the user's physical condition varies every day, before the exercise, the physical condition can control the exercise machine 10 to test the user's physical condition and adjust the personal training parameter 121 according to current physical condition, so as to prevent sport injury. The physical condition evaluation unit 17 can be built in the exercise machine 10, or disposed outside the exercise machine 10.

Under a condition that the personal training parameter 121 is adjusted, the control unit 11 can upload the adjusted personal training parameter 121 to the remote device 30. As a result, it is more convenient for the user to update the personal training parameter 121.

In an embodiment, the exercise system of the present disclosure further includes a multimedia output unit 16, such as a screen, a camera or a speaker, for displaying or broadcasting exercise instruction content, or recording the exercise information. For example, during exercise, a gym instructor at remote site can receive the user' exercise information to understand the user's exercise condition, and then instruct the user by video or voice through the multimedia output unit 16.

Figure 2:
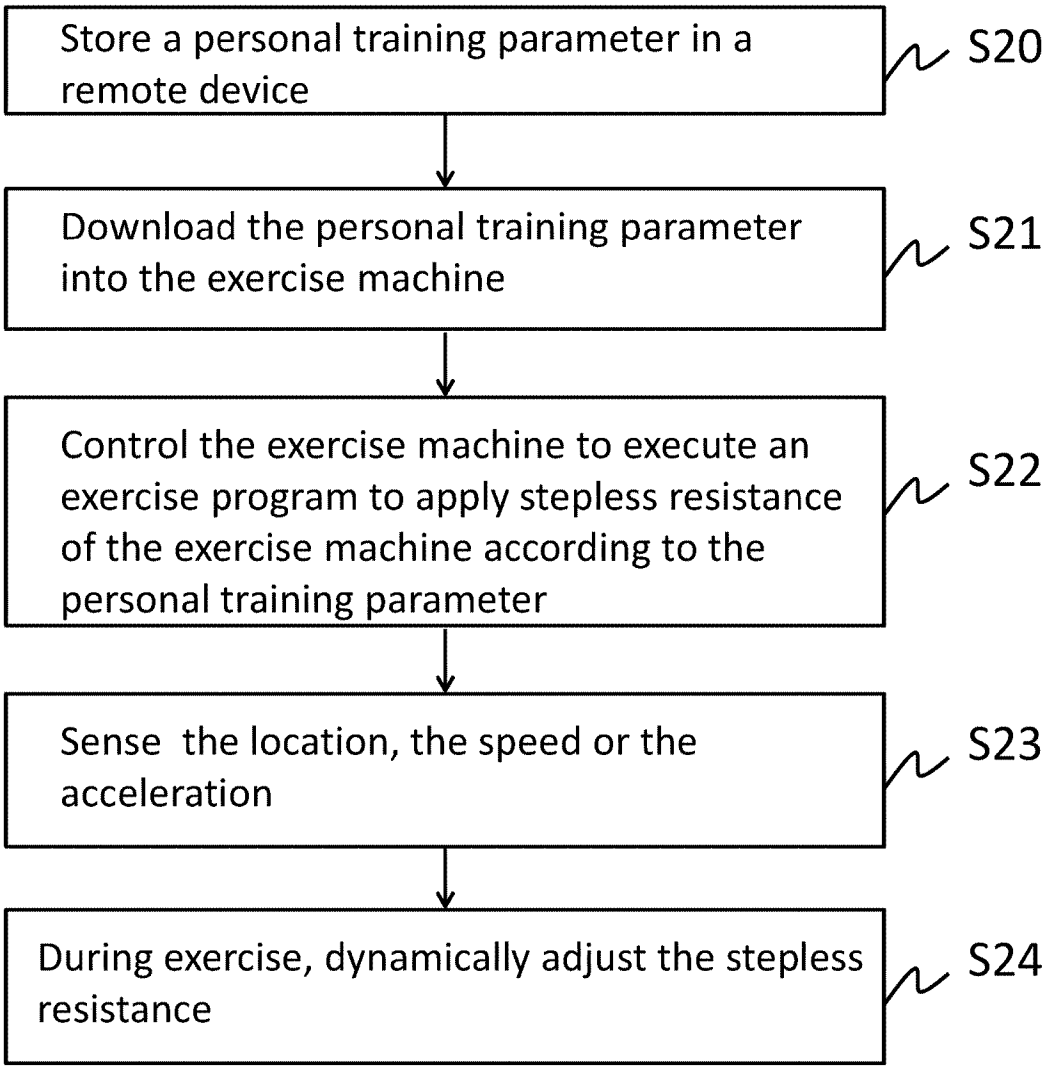
FIG. 2 is a flowchart of an adjustment method for an exercise machine, in accordance with the present disclosure.

Please refer to FIG. 2 which shows a flowchart of adjustment method for the exercise machine, in accordance with the present disclosure. The adjustment method is applicable to the exercise machine having a data transmission function. The adjust method of the present disclosure will be described in cooperation with the exercise system shown in FIG. 1.

In a step S20, the personal training parameter 121 is stored in the remote device 30.

In a step S21, the exercise machine 10 is communicated with the remote device 30 by a wired or wireless manner, so as to download the personal training parameter 121 into the exercise machine 10.

In a step S22, the exercise machine 10 is controlled to execute the exercise program 122 to output the resistance for exercise, according to the personal training parameter 121. The exercise program 122 has the preset resistance setting function 123 and the adjustable parameter 124 which has the corresponding relation with the location, the speed or the acceleration of the user operation part 14.

In a step S23, the location, the speed or the acceleration of the user operation part 14 during movement is sensed.

In a step S24, during exercise, the resistance is dynamically adjusted according to the sensed location, the speed or the acceleration, and the adjustable parameter 124. The way of dynamically adjusting the resistance is explained in above-described content, so the detailed description is omitted.

In an embodiment, prior to the exercise, the exercise machine 10 is controlled to test the user's physical condition, and adjust the personal training parameter 121 according to the user's physical condition.

Figure 5:
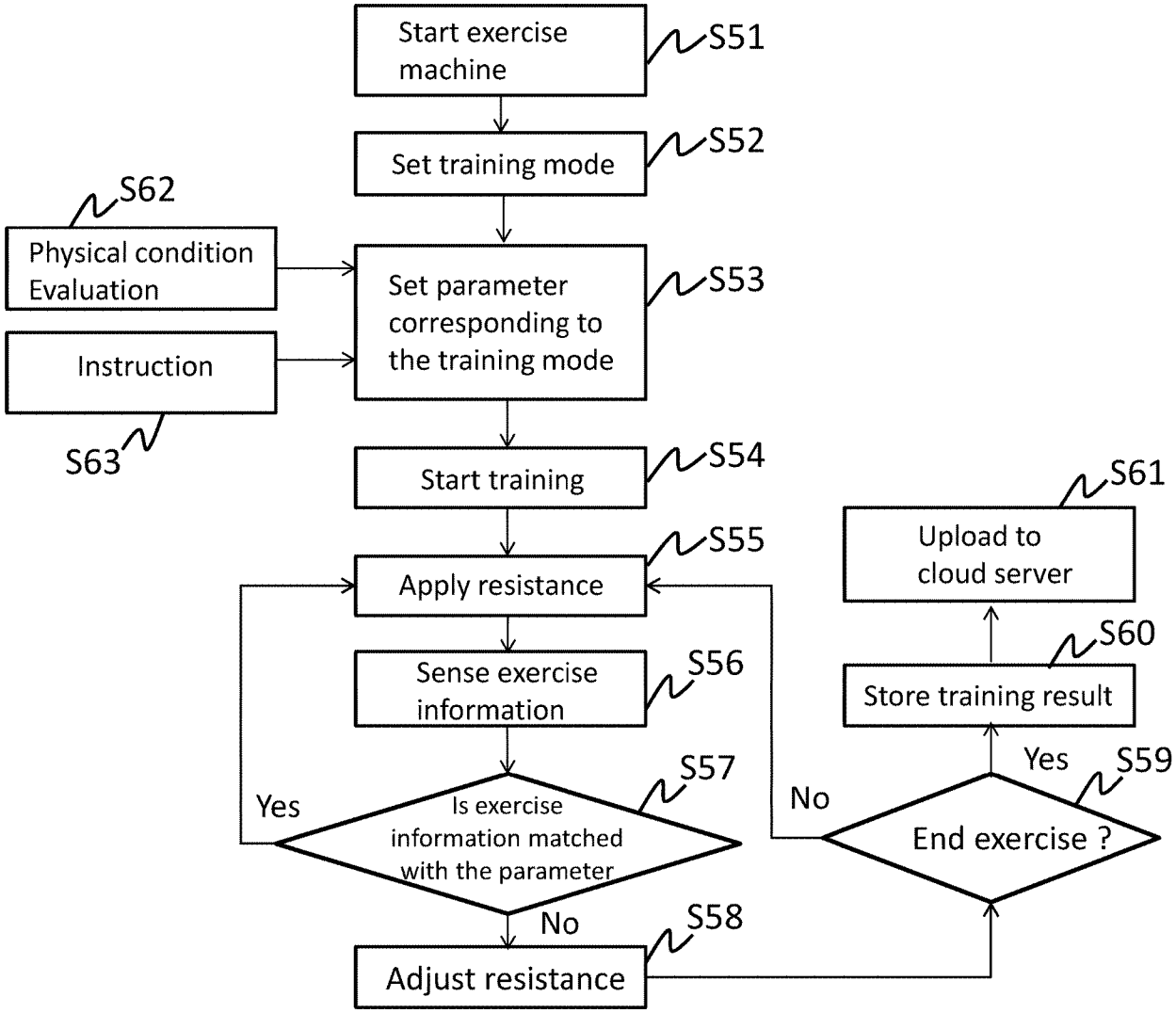
FIG. 5 is a flowchart of operating the exercise system of the present disclosure.

Please refer to FIG. 5 which shows a flowchart of operating the exercise system of the present disclosure. In a step S51, the exercise machine 10 is started. In a step S52, the training mode is set. For example, the user can directly set the training mode on the exercise machine 10, or download the personal training parameter from the remote device 30 to set the training mode.

After the training mode is set, in a step S53 the parameters corresponding to the training mode are set. The parameters relates to the generation of resistance for training, for example, the parameters include training category, limb movement range, resistance value, power value, the training time, the training cycles or the K value. In other embodiment, the adjustment method of the present disclosure further includes a step S62. In the step S62, the user is tested on the exercise machine 10 to evaluate current physical condition, and the parameters determined in the step S53 are selectively adjusted according to the physical condition. Alternatively, in other embodiment, the adjustment method of the present disclosure further includes a step S63 of providing an advice of adjusting the parameters by an instructor or from a database.

Next, in s step S54, the user starts exercise and, in a step S55, the exercise machine 10 starts to apply the stepless resistance on the user operation part 14 for the exercise of the user.

In a step S56, the exercise information is sensed to calculate the user's limb movement range, limb movement speed, training force or calorie consumption during exercise. For example, the exercise information includes the moving distance, the speed, the acceleration of the user operation part 14. In a step S57, it is determined whether current exercise information is matched with the parameters set in the step S53; if yes, it indicates that the user's exercise condition is normal, and the adjustment method then proceeds the step S55.

If current exercise information is not matched with the parameters set in the step S53, it indicates that the current resistance must be adjusted. In a step S58, the resistance applied on the user operation part 14 is increased or decreased. For example, the increasing or decreasing of the resistance is determined by product of the exercise information and the K value set in the step S53.

When the resistance is adjusted, it may indicate that the user is tired, so in a step S59 the user is asked whether the exercise should be ended. If yes, in a step S60 the training result is stored and the exercise is ended, and in a step S61 the training result is uploaded to the cloud server for storage and analysis.

In some embodiments, the exercise system and adjustment method of the present disclosure has at least one of advantages below, compared with conventional technology.

First, the exercise system of the present disclosure can store the personal training parameter in the remote device (such as a cloud server or the user's mobile phone) and download the personal training parameter to the exercise machine anytime, so that it is more convenient for the user to personalize the exercise machine, and the training effect can be improved and the sport injury can be prevented effectively.

Secondly, the exercise system of the present disclosure includes the physical condition evaluation unit to test the user's physical condition and adjust the personal training parameter according to the physical condition, so as to prevent the user from sport injury and improve the user's experience in every exercise.

Thirdly, the exercise system of the present disclosure can upload the exercise information of the exercise machine to the remote end, so the instructor at remote can instruct the user through multimedia output unit according to the exercise information.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An exercise system, comprising:

an exercise machine comprising:

a user operation part configured to be operated by a user for exercise;

a stepless force device configured to apply resistance on the user operation part;

a sensor configured to sense a location, a speed or an acceleration of the user operation part;

a storage unit configured to store a software application program, an exercise program, a personal training parameter and a training result, and wherein the exercise program comprises a preset resistance setting function and an adjustable parameter which has a corresponding relationship with the location, the speed or the acceleration of the user operation part;

an operation interface configured to provide the user to set the personal training parameter on the exercise machine; and a control unit configured to execute the exercise program to control the stepless force device to output resistance according to the personal training parameter, and dynamically adjust the resistance during exercise of the user according to the location, the speed or the acceleration and the adjustable parameter, and record the training result, and execute the software application program to display exercise information on the operation interface; and a data transmission device configured to communicate with a remote device, and wherein the control unit selectively downloads the personal training parameter from the remote device or uploads the training result and the personal training parameter to the remote device, through the data transmission device.

2. The exercise system according to claim 1, wherein the stepless force device is a motor, the control unit is configured to calculate a compensation force according to the location, the speed or the acceleration of the user operation part and the corresponding relation, and further adjust torque output of the motor according to the compensation force value.

3. The exercise system according to claim 1, wherein the corresponding relation is a linear relation, a nonlinear relation or a function, and the user sets the corresponding relation through the operation interface.

4. The exercise system according to claim 1, wherein during exercise of the user, the control unit is configured to record the exercise information of the user operation part, and compare the exercise information with the personal training parameter to determine adjustment of the resistance, and selectively adjust the personal training parameter.

5. The exercise system according to claim 1, further comprising a physical condition evaluation unit configured to control the exercise machine to test a physical condition of the user, and adjust the personal training parameter according to the physical condition.

6. The exercise system according to claim 1, further comprising a multimedia output unit configured to display or broadcast exercise instruction content.

7. An adjustment method for an exercise machine having data transmission function, comprising:

storing a personal training parameter in a remote device;

connecting the exercise machine and the remote device to download the personal training parameter into the exercise machine;

controlling the exercise machine to execute an exercise program to apply stepless resistance on a user operation part of the exercise machine according to the personal training parameter, and wherein the user operates the user operation part for exercise, and the exercise program comprises a preset resistance setting function and an adjustable parameter which has a corresponding relation with a location, a speed or an acceleration of the user operation part;

sensing the location, the speed or the acceleration of the user operation part which is being operated; and during exercise of the user, dynamically adjusting the stepless resistance according to the location, the speed or the acceleration and the adjustable parameter.

8. The adjustment method according to claim 7, wherein the exercise machine is equipped with a motor to output the stepless resistance, and the exercise machine calculates a compensation force value during exercise of the user according to the location, the speed or the acceleration of the user operation part and the corresponding relation, and adjusts torque output of the motor according to the compensation force value.

9. The adjustment method according to claim 7, wherein the corresponding relation is a linear relation, a nonlinear relation or a function, and the user sets the corresponding relation on the exercise machine.

10. The adjustment method according to claim 7, prior to exercise of the user, further comprising:

controlling the exercise machine to test a physical condition of the user; and adjusting the personal training parameter according to the physical condition.

* * * * *